US009640921B2

(12) United States Patent
Choi

(10) Patent No.: US 9,640,921 B2
(45) Date of Patent: May 2, 2017

(54) ELECTRICAL CONNECTOR AND ELECTRONIC DEVICE INCLUDING THE SAME

(71) Applicant: Samsung Electronics Co., Ltd., Gyeonggi-do (KR)

(72) Inventor: Jin-Chul Choi, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 14/934,779

(22) Filed: Nov. 6, 2015

(65) Prior Publication Data

US 2016/0141809 A1 May 19, 2016

(30) Foreign Application Priority Data

Nov. 18, 2014 (KR) ..... 10-2014-0160938

(51) Int. Cl.

| | |
|---|---|
| ***H01R 11/30*** | (2006.01) |
| ***H01R 13/66*** | (2006.01) |
| ***H01R 13/70*** | (2006.01) |
| ***H01R 13/62*** | (2006.01) |
| ***H01R 13/703*** | (2006.01) |
| *H01R 13/64* | (2006.01) |

(52) U.S. Cl.

CPC ..... *H01R 13/6683* (2013.01); *H01R 13/6205* (2013.01); *H01R 13/70* (2013.01); *H01R 13/703* (2013.01); *H01R 13/64* (2013.01); *H01R 2201/06* (2013.01)

(58) Field of Classification Search

CPC ..... H01R 13/6205
USPC ..... 439/38–40
See application file for complete search history.

(56) References Cited

U.S. PATENT DOCUMENTS

| | | | | |
|---|---|---|---|---|
| 7,351,066 | B2 * | 4/2008 | DiFonzo | H01R 13/641 439/39 |
| 7,722,358 | B2 * | 5/2010 | Chatterjee | G06F 3/03543 439/38 |
| 7,963,774 | B2 * | 6/2011 | Shiff | H01R 13/6205 439/38 |

(Continued)

FOREIGN PATENT DOCUMENTS

| | | |
|---|---|---|
| JP | 2006114258 | 4/2006 |
| KR | 1020140060770 | 5/2014 |
| WO | WO 2013/165049 | 11/2013 |

OTHER PUBLICATIONS

International Search Report dated Mar. 7, 2016 issued in counterpart application No. PCT/KR2015/012371, 10 pages.

(Continued)

*Primary Examiner* — Thanh Tam Le
(74) *Attorney, Agent, or Firm* — The Farrell Law Firm, P.C.

(57) ABSTRACT

A connector for coupling to a connector port of an electronic device including a coupling face for coupling with the connector port of the electronic device, at least one connector terminal disposed on one side of the coupling face, at least one first magnetic member disposed in the vicinity of the connector terminal and coupled with at least one first metal member located in the vicinity of the connector port of the electronic device, and a detection member disposed on at least a portion of the coupling face that detects a coupling between the connector and the connector port. An electronic device to which the connector device is applied is also disclosed.

20 Claims, 8 Drawing Sheets

(56) References Cited

U.S. PATENT DOCUMENTS

| | | | | |
|---|---|---|---|---|
| 8,172,580 | B1 * | 5/2012 | Chen | H01R 13/6205 320/111 |
| 8,512,048 | B2 * | 8/2013 | Yasuoka | H01R 13/447 439/39 |
| 8,596,881 | B2 * | 12/2013 | Umeno | G02B 6/3817 385/53 |
| 8,734,024 | B2 * | 5/2014 | Isenhour | G02B 6/3886 385/57 |
| 9,017,092 | B1 * | 4/2015 | McCracken | H01R 13/62 439/374 |
| 9,261,651 | B2 * | 2/2016 | Benjamin | G02B 6/3886 |
| 2007/0072443 | A1 | 3/2007 | Rohrbach et al. | |
| 2009/0181556 | A1 | 7/2009 | Rohrbach et al. | |
| 2010/0120290 | A1 | 5/2010 | Ko | |
| 2011/0092081 | A1 | 4/2011 | Gao et al. | |
| 2011/0136351 | A1 | 6/2011 | Rohrbach et al. | |
| 2012/0135626 | A1 | 5/2012 | Tormey et al. | |
| 2013/0316549 | A1 | 11/2013 | DiFonzo et al. | |
| 2014/0300321 | A1 | 10/2014 | Kim et al. | |

OTHER PUBLICATIONS

European Search Report dated Mar. 18, 2016 issued in counterpart application No. 15195218.1-1801, 8 pages.

* cited by examiner

ELECTRICAL CONNECTOR AND ELECTRONIC DEVICE INCLUDING THE SAME

PRIORITY

This application claims priority under 35 U.S.C. §119(a) to a Korean Patent Application filed in the Korean Intellectual Property Office on Nov. 18, 2014 and assigned Serial No. 10-2014-0160938, the entire disclosure of which is incorporated herein by reference.

BACKGROUND OF THE INVENTION

1. Field of the Invention

The present disclosure relates to an electrical connector device for an electronic device.

2. Description of the Related Art

Electronic devices (e.g., a smart phone, a smart watch, etc.) have recently been changing to portable or wearable types. Therefore, a connector device is required to charge a battery of the electronic devices or to transmit/receive data by interworking with an external device (e.g., a Personal Computer (PC), etc.).

Conventionally, a connector port having an inserting groove in one surface of the electronic device is mounted to a Printed Circuit Board (PCB) inside the electronic device and is configured to be partially exposed to the outside, and an electrical connection is made in such a manner that a connector installed on one end of the connector device is inserted to the inserting groove, thereby enabling charging and/or data transmission/reception functions.

In addition, an attach-type electrical connector device using a magnet has been introduced in addition to the inserting mechanism. The attach-type electrical connector device has a plurality of connector pins protruding from a connector body, and at least one magnet is installed on each of both sides of the connector pin. In addition, exposed terminals are installed at a corresponding connector port of the electronic device, and a material attachable to a magnet such as iron or the like is installed on left and right sides of the terminal. Therefore, if a connector of the electrical connector device is located around the connector port of the electronic device, a magnet installed on the connector is attached to the material attachable to the magnet of the electronic device, while the connector pin can be electrically connected to the exposed terminal of the electronic device. Alternatively, a pogo pin may be used as a connector pin of such an attach-type electrical connector device.

However, since a connector device to be inserted into an electronic device as described above is becoming smaller in size and thinner in weight, it is difficult to connect the connector device to the electronic device, and there is a problem in that a connector connecting portion may be damaged by an impact randomly applied from the outside, or more seriously, a connector port of the electronic device may be damaged.

When terminals are randomly connected to each other by a metal material attracted by magnetism generated by a magnet exposed to the outside of a connector of the aforementioned attach-type electrical connector device, and in this case, if the connector device is connected to an external device having an external power source, a disconnection (or a short circuit) occurs, which leads to the aforementioned problem in that the electrical connector device may be damaged or may malfunction.

SUMMARY OF THE INVENTION

Accordingly, an aspect of the present disclosure provides a method of avoiding a disconnection even if a metal material is attached to a magnet exposed to the outside of a connector, and as a result, it is possible to provide an electrical connector device implemented to ensure reliability of the device.

According to an aspect of the present disclosure, a connector for coupling to a connector port of an electronic device is provided. The connector includes a coupling face for coupling with the connector port of the electronic device; at least one connector terminal disposed on one side of the coupling face; at least one first magnetic member disposed in the vicinity of the connector terminal and coupled with at least one first metal member located in the vicinity of the connector port of the electronic device; and a detection member disposed on at least a portion of the coupling face and that detects a coupling between the connector and the connector port.

According to another aspect of the present disclosure, a connector device electrically connected to a connector port of an electronic device is provided. The connector device includes a cable; an external device connector installed at one end of the cable and connected to an external device; a connector installed at the other end of the cable and having at least one connector pin for connecting to the connector port of the electronic device; at least one magnetic member disposed on a coupling face of the connector to face the connector port and providing coupling strength caused by an attractive force with respect to at least one metal member disposed on the connector port; and a detection member disposed in the vicinity of the connector pin of the connector and configured to facilitate an electrical connection with the electronic device only when the connector is coupled to the connector port.

According to another aspect of the present disclosure, an electronic device is provided. The electronic device includes a connector port including at least one terminal and at least one magnetic member disposed in the vicinity of the terminal; and a detection member for detecting a coupling of a connector connected to the connector port, wherein an electrical connection with the connector is completed when coupling is detected by the detection member.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION OF EMBODIMENTS OF THE PRESENT DISCLOSURE

Figure 1:
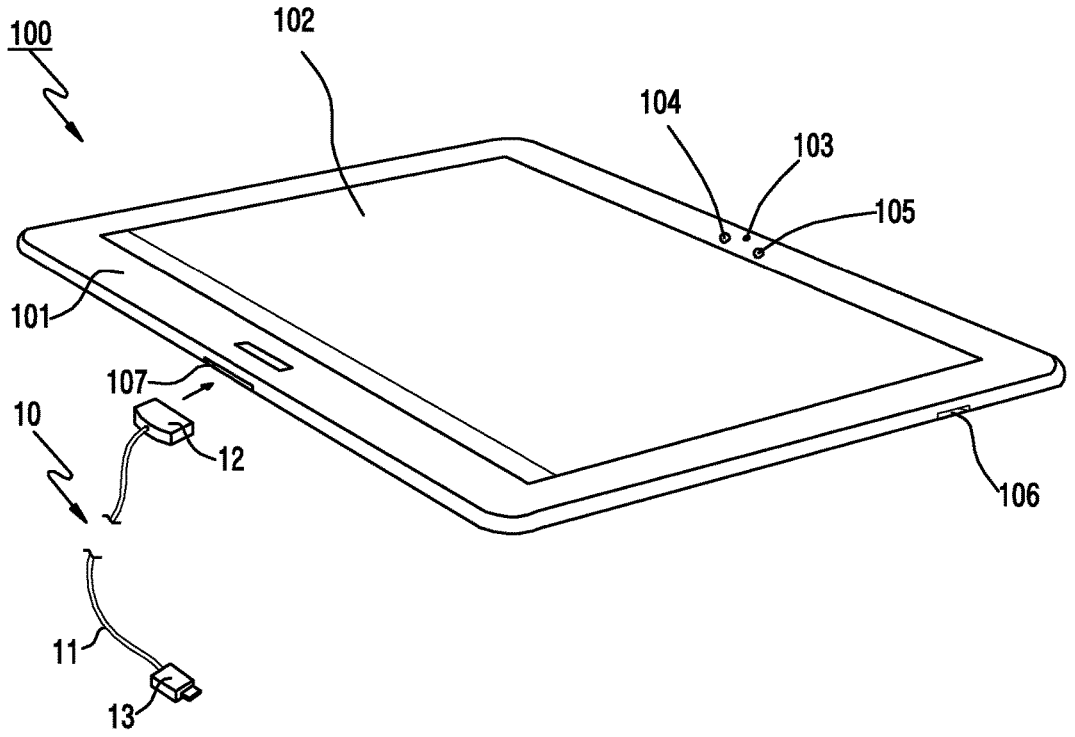
FIG. 1 is a perspective view of an electronic device to which an electrical connector device is applied according to an embodiment of the present disclosure.

Hereinafter, embodiments of the present disclosure are described with reference to the accompanying drawings. While the embodiments of the present disclosure are susceptible to various modifications and alternative forms, a specific embodiment thereof has been shown by way of example in the drawings and will herein be described in detail. It should be understood, however, that it is not intended to limit the present disclosure to the particular form disclosed, but, on the contrary, the embodiments of the present disclosure are to cover all modifications, equivalents, and alternatives falling within the spirit and scope of the present disclosure as defined by the appended claims. Like reference numerals denote like elements throughout the drawings.

The expressions "include" or "may include" used in describing the present disclosure are intended to indicate the presence of a corresponding function, operation, or element disclosed herein, and are not intended to limit the presence of one or more functions, operations, or elements. In addition, the terms "include" or "have" are intended to indicate that characteristics, numbers, steps, operations, and elements disclosed in this specification or combinations thereof exist. As such, the term "include" or "have" should be understood to include additional possibilities of one or more other characteristics, numbers, steps, operations, elements or combinations thereof.

In the present disclosure, the expression "or" includes any and all combinations of words enumerated together. For example, "A or B" may include A or B, or may include both of A and B.

Although expressions used in describing the embodiments of the present disclosure such as "$1^{st}$", "$2^{nd}$", "first", "second" may be used to express various elements, they are not intended to limit the corresponding elements. For example, the above expressions are not intended to limit an order or an importance of the corresponding elements. The above expressions may be used to distinguish one element from another element. For example, a $1^{st}$ user device and the $2^{nd}$ user device are both user devices, and indicate different user devices. For example, a $1^{st}$ element may be referred to as a $2^{nd}$ element, and similarly, the $2^{nd}$ element may be termed the $1^{st}$ element without departing from the scope of the embodiments of the present disclosure. When an element is described as being "connected" to or "accessing" another element, this may mean that it is directly connected to or accesses the other element, but it is to be understood that there are no intervening elements present. On the other hand, when an element is mentioned as being "directly connected" to or "directly accessing" another element, it is to be understood that there are no intervening elements present.

The terminology used in describing embodiments of the present disclosure is for the purpose of describing particular embodiments only and is not intended to limit of the embodiments of the present disclosure. A singular expression includes a plural expression unless there is a contextually distinctive difference therebetween.

Unless otherwise defined, all terms (including technical and scientific terms) used herein have the same meaning as commonly understood by those of ordinary skill in the art to which the present disclosure belongs. It will be further understood that terms, such as those defined in commonly used dictionaries, should be interpreted as having meanings that are consistent with their meaning in the context of the relevant art, and will not be interpreted in an idealized or overly formal sense unless expressly so defined herein.

Hereinafter, an electrical connector device which is connected to an electrical connector according to embodiments of the present disclosure will be described with reference to the accompanying drawings. A term 'user' used in describing the embodiments may refer to a person who uses the electrical connector device and an electronic device, or a device (e.g., an artificial intelligence electronic device) which uses the electrical connector device and the electronic device.

An electronic device according to embodiments of the present disclosure may be a device including a communication function. For example, the electronic device may include at least one of a smart phone, a tablet personal computer (PC), a mobile phone, a video phone, an e-book reader, a desktop PC, a laptop PC, a netbook computer, a personal digital assistant (PDA), a portable multimedia player (PMP), an MPEG-1 Audio Layer 3(MP3) player, a mobile medical device, a camera, and a wearable device, such as a head-mounted-device (HMD) such as electronic glasses, electronic clothes, an electronic bracelet, an electronic necklace, an electronic accessory, an electronic tattoo, or a smart watch.

According to certain embodiments, the electronic device may be a smart home appliance having a communication function. For example, the smart home appliance may include at least one of a television (TV), a digital video disk (DVD) player, an audio, a refrigerator, an air conditioner, a cleaner, an oven, a microwave oven, a washing machine, an air purifier, a set-top box, a TV box (e.g., Samsung HomeSync™, Apple TV™, or Google TV™), a game console, an electronic dictionary, an electronic key, a camcorder, and an electronic picture frame.

According to certain embodiments, the electronic device may include at least one of various medical devices such as magnetic resonance angiography (MRA) devices, magnetic resonance imaging (MRI) machines, computed tomography (CT) equipment, imaging equipment, and ultrasonic instruments, etc., a navigation device, a global positioning system (GPS) receiver, an event data recorder (EDR), a flight data recorder (FDR), a car infotainment device, an electronic equipment for a ship (e.g., a vessel navigation device, a gyro compass, etc.), avionics, a security device, a car head unit, an industrial or domestic robot, automatic teller machines (ATMs) of financial institutions, and point of sales (POS) devices of shops.

According to certain embodiments, the electronic device may include at least one of a furniture or a part of building/constructions including a communication function, an electronic board, an electronic signature input device, a projector, and various measurement machines such as for the water supply, electricity, gas, a propagation measurement machine, etc. The electronic device according to embodiments of the present disclosure may be one or more combinations of the aforementioned various devices. The electronic device may be a flexible device. In addition, it is apparent to those of ordinary skill in the art that the electronic device according to the embodiments of the present disclosure is not limited to the aforementioned devices.

FIG. 1 is a perspective view of an electronic device 100 to which an electrical connector device 10 is applied according to an embodiment of the present disclosure.

Referring to FIG. 1, the electronic device 100 is a tablet-type mobile terminal. However, the present disclosure is not limited thereto, and thus may be applied to various types of electronic devices. According to an embodiment, the electronic device 100 may have a display 102 disposed to a front surface 101. Further, a microphone 103, a camera module 104, and a sensor module 105 may be installed on an upper portion of the electronic device 100. According to an embodiment, the sensor module 105 may include at least one of an illumination sensor, a proximity sensor, an infrared sensor, an ultrasonic sensor, and a heart rate measurement sensor for healthcare. A speaker module 106 may be installed on both lateral surfaces of the electronic device 100 to output voice, music, or the like when a multimedia object is played back. Although not shown, another camera module may also be disposed on a rear surface of the electronic device 100, and a flash may be applied around the camera module.

According to an embodiment, a connector port 107 may be disposed on a lower side of the electronic device 100 to apply the electrical connector device 10. However, the present disclosure is not limited thereto, and thus at least one connector port 107 may be disposed at various positions of the electronic device.

According to an embodiment, the electrical connector device 10 may include a cable 11 having a specific length, a pogo connector 12 installed at one end of the cable 11 and electrically connectable by contact with the connector port 107, and an external device connecting connector 13 installed at the other end of the cable 11 so as to be connected to a power source (e.g., Alternating Current (AC) power) or an external device (e.g., Personal Computer (PC)). According to an embodiment, the external device connecting connector 13 may be a Universal Serial Bus (USB) socket to be electrically connected to an adaptor connected to an external power source.

Even if the external device connecting connector 13 is electrically connected to a power source or an external device for data transmission/reception, power is not supplied to a pogo pin (see 124 of FIG. 2) protruding from the pogo connector until the pogo connector 12 is physically in contact with the connector port 107 of the electronic device 100. Since power is not applied to the pogo connector 12 before being connected to the connector port 107 of the electronic device 100, pogo pins are prevented from being disconnected due to an external conductive material. Therefore, the electrical connector device avoids malfunction and damage.

Figure 2:
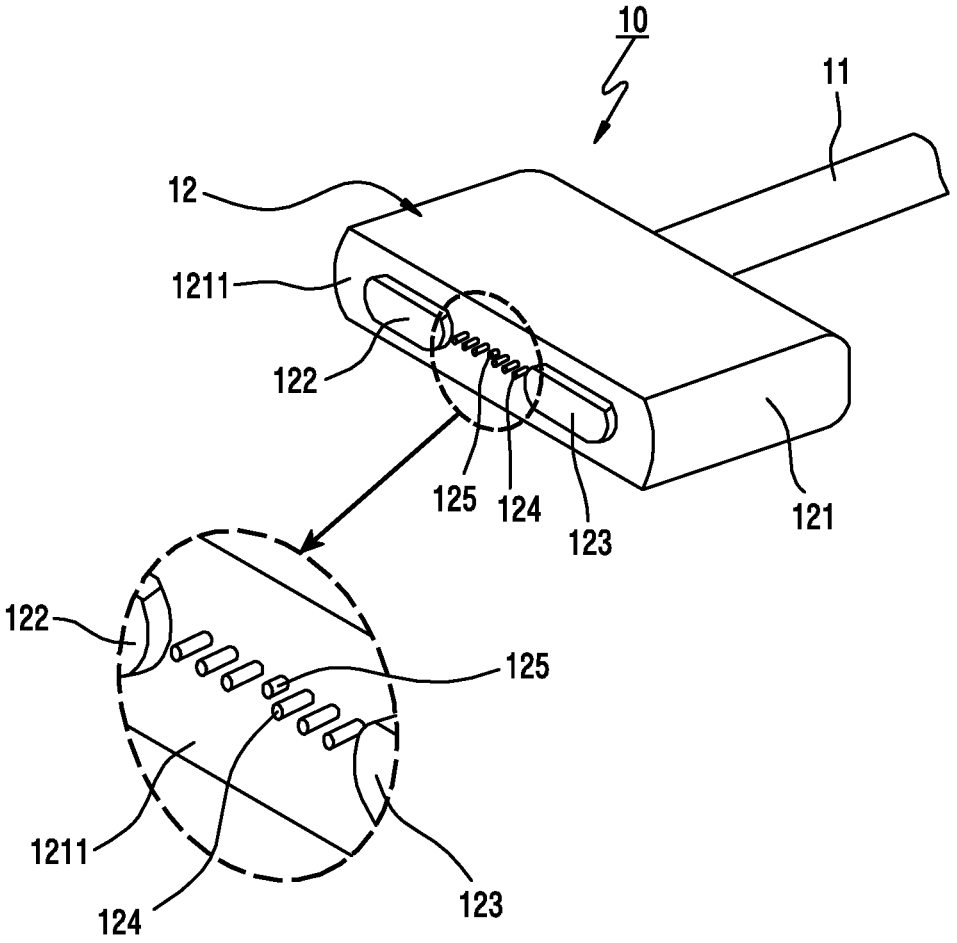
FIG. 2 is a perspective view illustrating in detail parts of an electrical connector device according to an embodiment of the present disclosure.
Figure 3:
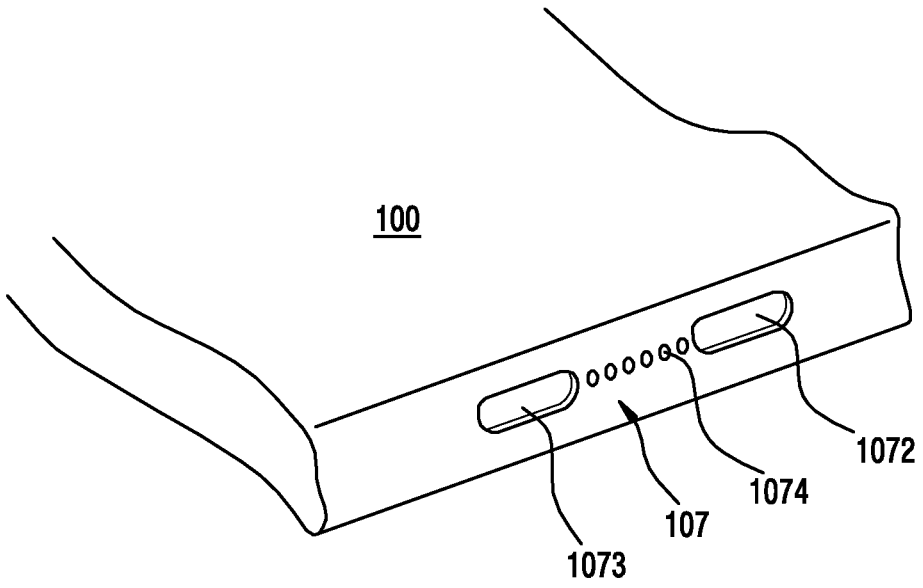
FIG. 3 is a perspective view illustrating in detail parts of a connector port of an electronic device according to an embodiment of the present disclosure.

FIG. 2 is a perspective view illustrating in detail parts of the electrical connector device 10 according to an embodiment of the present disclosure. FIG. 3 is a perspective view illustrating in detail parts of the connector port 107 of the electronic device according to an embodiment of the present disclosure.

Referring to FIG. 2 and FIG. 3, the pogo connector 12 of the electrical connector device 10 includes a body 121 having a specific shape and a plurality of pogo pins 124 installed at a specific interval between pins and protruding from a coupling face 1211 of the body 121 for connection to the connector port 107. According to an embodiment, a detection pin 125 may be disposed in the vicinity of the pogo pin 124. The pogo pin 124 may have a structure which is capable being depressed into the body 121 when it is pressed, and the detection pin 125 may also be installed to have the same structure. The detection pin 125 may be implemented in such a manner that power supplied to the pogo pin 124 is disconnected when the detection pin 125 is in a state in which it protrudes from the coupling face 1211, and the power is supplied to the pogo pin 124 when the detection pin 125 is in a state in which it is depressed into the coupling face, so that the power is supplied to the electronic device 100 and data can be transmitted/received only when the pogo pin 124 is placed to the connector port 107. After the pogo connector 12 is properly placed with respect to the connector port 107, in order to supply power, a protruding length of the detection pin 125 may be at least shorter than a protruding length of the pogo pin 124.

According to an embodiment, at least one magnet joining member 122 may be disposed on the coupling face 1211 of the pogo connector body 121 to provide coupling strength with respect to the connector port 107 of the electronic device 100. A metal joining portion 1072 which is coupled to the magnet joining member 122 by magnetism may be disposed at an area in the vicinity of the connector port 107 of the electronic device 100, corresponding to the magnet joining member 122.

According to an embodiment, an additional metal joining member 123 may be disposed on the coupling face 1211 of the pogo connector body 121, for coupling to a magnet joining portion 1073 by magnetism in the vicinity of the connector port 107 of the electronic device 100. A polarity of the magnet joining member 122 of the pogo connector 12 and a polarity of the magnet joining portion 1073 of the connector port 107 may be configured identically.

According to various embodiments, if the pogo connector 12 is normally placed, the magnet joining member 122 of the pogo connector 12 may be attached to the metal joining portion 1072 of the connector port 107, and the metal joining member 123 of the pogo connector 12 may be attached to the magnet joining portion 1073 of the connector port 107.

According to an embodiment, if the pogo connector 12 is placed abnormally, for example, in a reverse direction, since the magnet joining member 122 of the pogo connector 12 and the magnet joining portion 1073 of the connector port 107 are configured with the same polarity, a repulsive force is generated. Therefore, the pogo pin 124 would not be electrically connected to a terminal 1074 provided in the connector port 107.

The magnet joining member 122 of the pogo connector 12 may have an N or S polarity, and the metal joining member 123 may be formed of pure iron to be affected by the magnetism of the magnet joining member 122. According to an embodiment, the magnet joining member 122 and the metal joining member 123 are formed to have the same shape.

The magnet joining member 122 and metal joining member 123 of the pogo connector 12 may be spaced apart by a specific interval, and the pogo pin 124 may be disposed between the magnet joining member 122 and the metal joining member 123.

The pogo pin 124 is installed in such a manner that pins (for example, 6 pins) protrude from the coupling face at a specific interval between each pin, each of which being pressed outwardly by an internal elastic member, and when the pins are in contact with the terminal 1074 disposed on the face of connector port 107 of the electronic device, may be in contact by being internally depressed by a specific amount. Therefore, even if the pogo connector 12 is slightly loose or moves, an electrical connection can be always maintained due to a structure of the aforementioned pogo pin 124. According to an embodiment, the pogo pin 124 may include, for example, a terminal for data transmission/reception, a power supply terminal, and a GrouND (GND) terminal. However, the present disclosure is not limited thereto, and thus the number of pogo pins 124 may be variously applied according to a function, type, or the like of the electronic device.

According to an embodiment, in a joining structure between the pogo connector 12 and the electronic device 100, one magnet joining member 122 and one metal joining member 123 are disposed on the pogo connector 12, and corresponding thereto, the metal joining portion 1072 and the magnet joining portion 1073 are disposed on the connector port 107 of the electronic device 100. However, the present disclosure is not limited thereto. For example, only magnet may be disposed on the coupling face 1211 of the pogo connector 12 such that at least one portion thereof is exposed or not exposed, and only one metal joining portion may be disposed on the connector port 107 of the electronic device 100 in an area corresponding thereto.

Figure 4A:
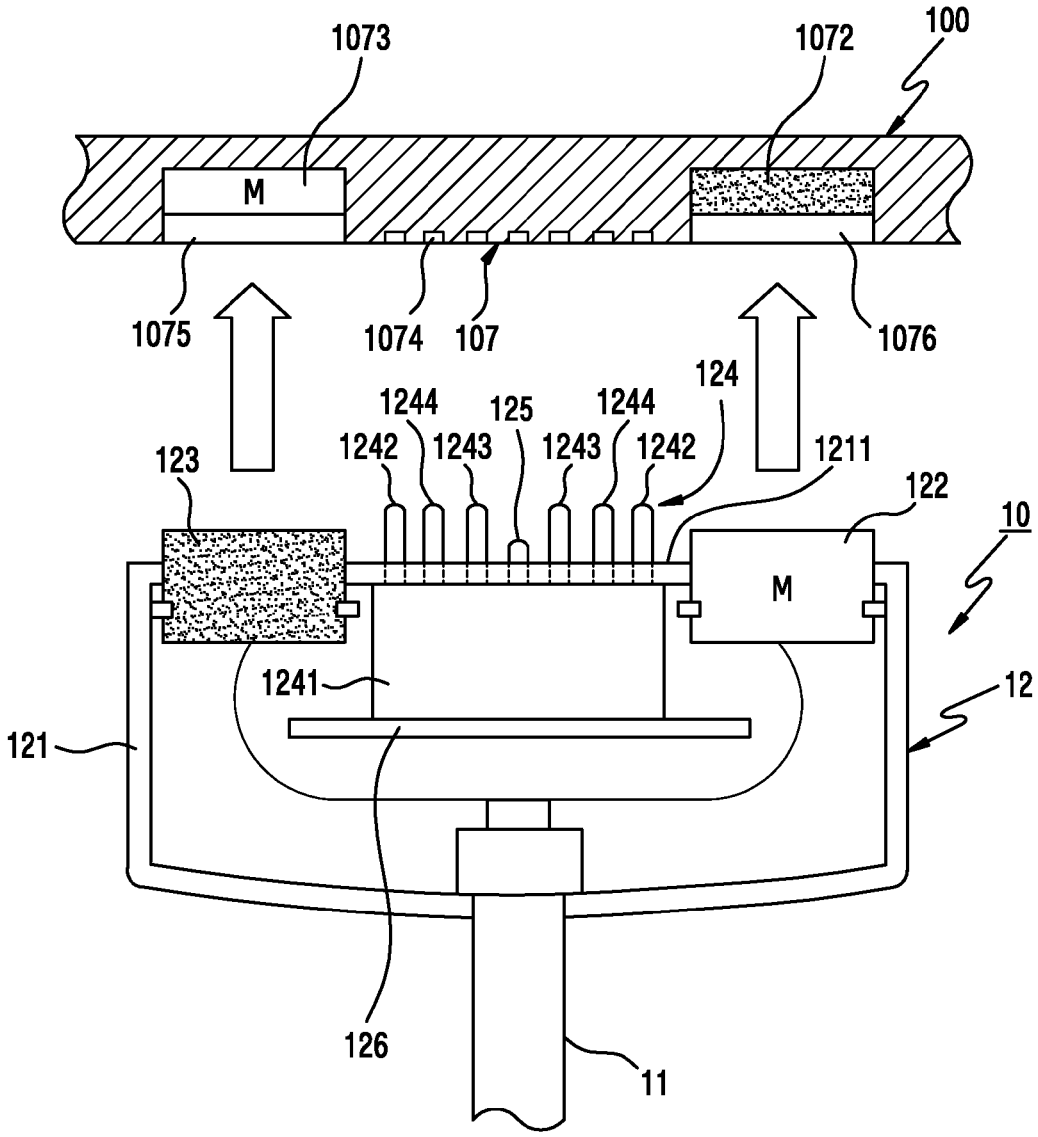
FIG. 4A is a cross-sectional view illustrating in detail parts of an electrical connector device and a connector port of an electronic device according to an embodiment of the present disclosure.

FIG. 4A is a cross-sectional view illustrating in detail parts of the electrical connector device 10 and the connector port 107 of the electronic device 100 according to an embodiment of the present disclosure.

Referring to FIG. 4A, a specific Printed Circuit Board (PCB) 126 may be installed inside the pogo connector 12 of the electrical connector device 10, and a pogo pin unit 1241 including a plurality of pogo pins 1242, 1243, and 1244 may be mounted on the PCB 126. According to an embodiment, the aforementioned pogo pins protrude by a specific length from the pogo pin unit 1241, and may be installed such that one portion thereof is exposed outside a body 121 of the pogo connector 12. The detection pin 125 may also be installed on the PCB 126, and may protrude together from the pogo pin unit similarly to the plurality of pogo pins. As illustrated, the plurality of pogo pins are formed of 6 pins. Herein, as an example, one pair of power pins 1243 may be disposed near the center, data transmission/reception pins 1244 may be disposed at each of both sides of the power pins 1243, and ground pins 1242 may be disposed at each of both sides of the data transmission/reception pins 1244. According to an embodiment, the detection pin 125 may be disposed at the center of the aforementioned pogo pins 1242, 1243, and 1244. However, the present disclosure is not limited thereto, and thus the detection pin 125 may be disposed at any position on the coupling face 1211 of the pogo connector 12.

The magnet joining member 122 and the metal joining member 123 may be disposed on the pogo connector 12, and the magnet joining member 122 and the metal joining member 123 may be installed to protrude by a specific height from the coupling face 1211 of the body 121. According to an embodiment, the metal joining portion 1072 and the magnet joining portion 1073 which are disposed on the connector port 107 of the electronic device 100 may be disposed inside mounting grooves 1076 and 1075, respectively, formed on the connector port 107.

Figure 4B:
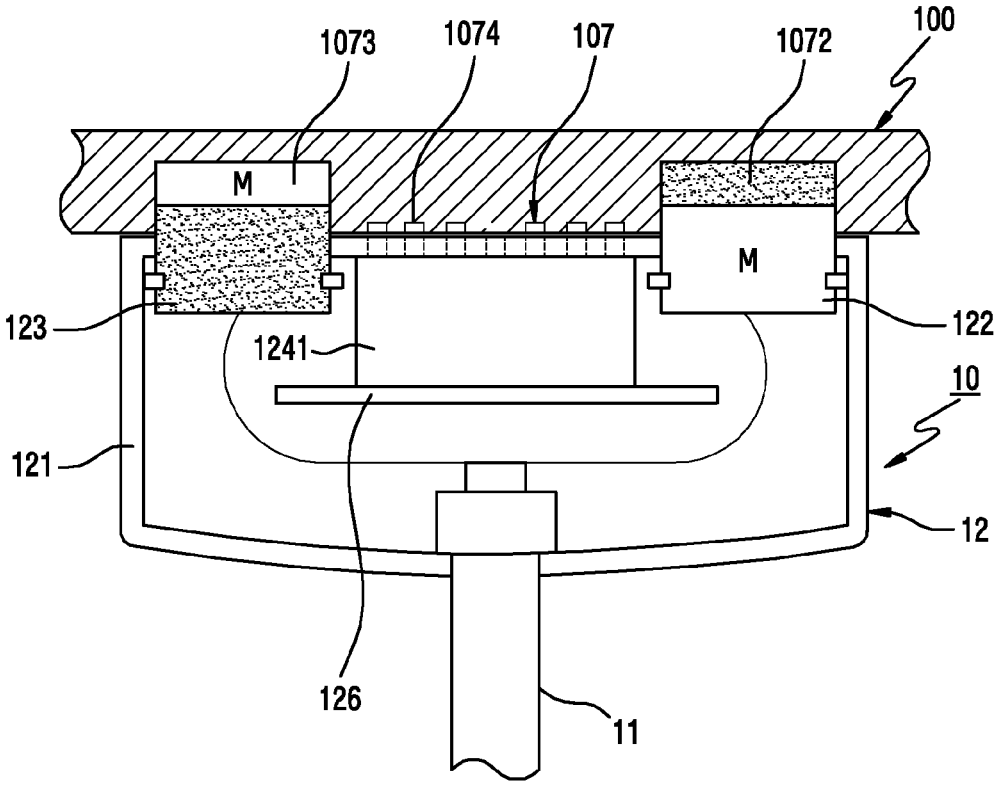
FIG. 4B is a cross-sectional view illustrating in detail a state in which an electrical connector device is placed in a connector port of an electronic device according to an embodiment of the present disclosure.

FIG. 4B is a cross-sectional view illustrating in detail a state in which the electrical connector device 10 is mounted to the connector port 107 of the electronic device 100 according to an embodiment of the present disclosure.

Referring to FIG. 4B, if the pogo connector 12 is connected to the connector port 107, the magnet joining member 122 and the metal joining member 123 are mounted respectively within mounting grooves 1076 and 1076, and thus may be attached to the metal joining portion 1072 and the magnet joining portion 1073 by magnetism. The pogo pins 1242, 1243, and 1244 of the pogo connector 12 may be depressed into the pogo pin unit 1241 due to the terminal 1074 being exposed on the connector port 107. At the same time, the detection pin 125 may also be depressed into the pogo pin unit 1241 due to a surface of the connector port 107. In this case, according to an operation in which the detection pin 125 is depressed, power may be supplied to the pogo pins 1242, 1243, and 1244 to perform a charging operation, or a data communication enabled state may be maintained. On the contrary, if the pogo connector 12 is separated from the electronic device 100, the pogo pins 1242, 1243, and 1244 and the detection pin 125 may be restored back to an original position as shown in FIG. 4A, and thus power supply and data communication are disabled. In a state where the pogo connector 12 is separated from the electronic device 100 according to such an operation, a short or the like may not occur even if a conductive material is attached to the pogo pins 1242, 1243, and 1244 exposed to the outside due to magnetism of the magnet joining member 122.

Figure 5:
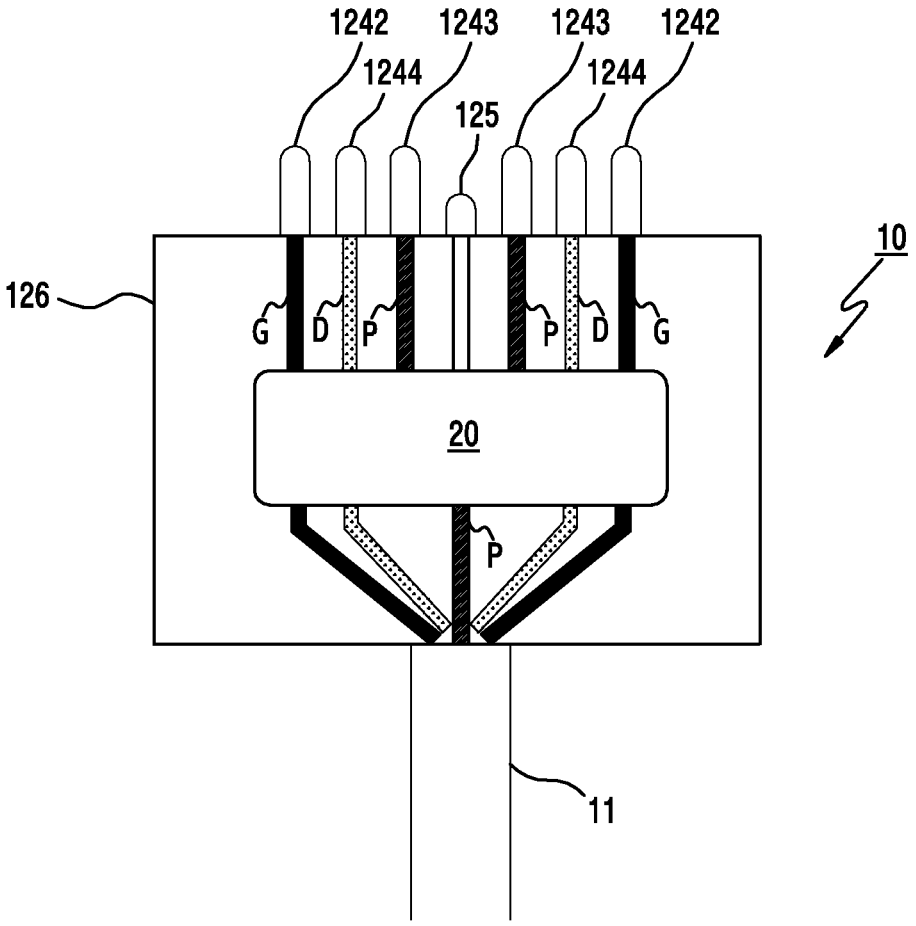
FIG. 5 schematically illustrates a connection structure of an electrical connector device according to an embodiment of the present disclosure.

FIG. 5 schematically illustrates a connection structure of the electrical connector device 10 according to an embodiment of the present disclosure.

Referring to FIG. 5, each of the pogo pins 1242, 1243, and 1244 may be electrically connected to the PCB 126 through the cable 11. According to an embodiment, among the pogo pins 124, the power pins 1243 may be connected to a power line P, the data transmission/reception pins 1244 may be connected to a data transmission/reception line D, and the ground pins 1242 may be electrically connected to a ground line G.

According to an embodiment, a switching unit 20 may be connected in-line to the power line P, the data transmission/reception line D, and the ground line G. The detection pin 125 may be electrically connected to the switching unit 20. The switching unit 20 may selectively disconnect or connect the power line P, the data transmission/reception line D, and the ground line G according to an operation of the detection pin 125. For example, only the power line P may be selectively connected to the pogo pins 1243 for supplying power by the switching unit 20. For another example, only the data transmission/reception line D may be selectively connected to the pogo pins 1244 for data transmission/reception by the switching unit 20. As another example, the switching unit 20 may be mounted on the PCB 126 in a Surface Mounted Device (SMD) manner, or may be disposed separately from the PCB 126.

Figure 6A:
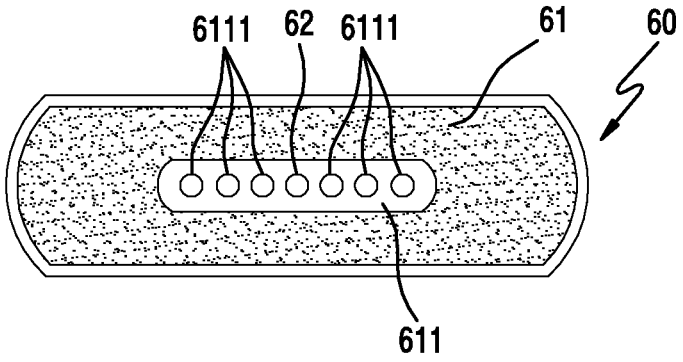
FIG. 6A and FIG. 6B illustrate a coupling face of an electrical connector device according to an embodiment of the present disclosure.
Figure 6B:
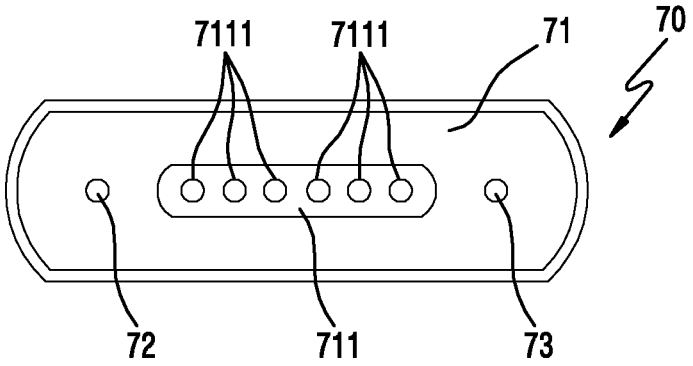

FIG. 6A and FIG. 6B illustrate a coupling face of the electrical connector device 10 according to an embodiment of the present disclosure.

Referring to FIG. 6A, a magnet may be disposed on the entirety of a coupling face 61 of a pogo connector 60 with respect to the connector port of the electronic device, except for a pogo pin installation area 611. In this case, a detection pin 62 may be installed at one part of the pogo pin installation area 611.

Referring to FIG. 6B, at least one or more detection pins 72 and 73 may be installed on a coupling face 71 of a pogo connector 70 with respect to the connector port of the electronic device. In this case, the detection pins 72 and 73 may be installed at an area of the coupling face 71, except for a pogo pin installation area 711. However, the present disclosure is not limited thereto, and thus the detection pins 72 and 73 may also be installed inside the pogo pin installation area 711. According to an embodiment, if one pair of the detection pins 72 and 73 is installed on the coupling face, the detection pins 72 and 73 may be disposed at positions facing each other in the coupling face 71, and thus may be changed to a state in which power can be supplied from a power source and data can be transmitted/received only when the two detection pins 72 and 73 are both depressed into the pogo connector.

According to various embodiments, at least one magnet is disposed on a pogo connector, and only metals affected by magnetism of a magnet are disposed around a connector port of an electronic device.

While certain embodiments of the present disclosure have been shown and described herein, it will be understood by those skilled in the art that various changes in form and details may be made therein without departing from the spirit and scope of the present disclosure as defined by the appended claims and their equivalents. Therefore, the scope of the present disclosure is defined not by the detailed description of the present disclosure but by the appended claims and their equivalents.

What is claimed is:

1. A connector for coupling to a connector port of an electronic device, comprising:

a coupling face for coupling with the connector port of the electronic device;

at least one connector terminal disposed on the coupling face;

at least one first magnetic member disposed in the vicinity of the at least one connector terminal and coupled with at least one first metal member located in the connector port of the electronic device; and a detection member disposed on the coupling face and that detects a coupling between the connector and the connector port, wherein when the detection member protrudes from the coupling face, power supplied from an external device, to the at least one connector terminal, is disconnected; and wherein when the detection member is depressed into the coupling face, power is supplied from the external device to the at least one connector terminal.

2. The connector of claim 1, wherein the detection member comprises a detection pin that detects placement of the connector by being moved in a direction away from a surface of the connector port, when the connector is coupled to the connector port.

3. The connector of claim 2, further comprising a switch for performing a switching operation when the detection pin moves, wherein power is supplied to the connector port by the switching operation of the switch.

4. The connector of claim 2, wherein the at least one connector terminal includes a plurality of connector pins protruding with a specific interval between each of the plurality of connector pins, and wherein the detection pin is disposed between the plurality of connector pins.

5. The connector of claim 4, wherein a height of the detection pin is less than or equal to a height of the plurality of connector pins.

6. The connector of claim 2, wherein the detection pin is disposed such that one pair of detection pins facing each other is disposed on the coupling face by placing the connector terminal between the detection pins.

7. The connector of claim 1, wherein the detection member is an electrical sensor for detecting that the connector is coupled to the connector port.

8. The connector of claim 7, wherein the electrical sensor is at least one of a proximity sensor and a photo sensor.

9. The connector of claim 1, wherein at least one second magnetic member is disposed in the vicinity of the connector port to induce attachment of at least one second metal member disposed on the coupling face.

10. The connector of claim 9, wherein the first magnetic member disposed on the connector and the second magnetic member disposed on the connector port are disposed at positions not overlapping with each other when the connector is coupled to the connector port.

11. The connector of claim 10, wherein the first magnetic member disposed on the connector and the second magnetic member disposed on the connector port are configured to expose the same polarity so as to be pushed apart by a repulsive force when the connector is abnormally placed with respect to the connector port.

12. The connector of claim 1, wherein the first magnetic member is disposed on the entirety of the coupling face, except for an installation area of the at least one connector terminal.

13. The connector of claim 1, wherein the connector electrically connects the electronic device and the external device through a cable, and the external device is a power source for charging a battery of the electronic device.

14. The connector of claim 1, wherein the connector electrically connects the electronic device and the external device through a cable, and the external device is a data transmission/reception device for performing data transmission/reception with respect to the electronic device.

15. The connector of claim 1, wherein the at least one connector is a pogo connector including a plurality of pogo pins.

16. A connector device electrically connected to a connector port of an electronic device, comprising:

a cable;

an external device connector installed at one end of the cable and connected to an external device;

a connector installed at the other end of the cable and having at least one connector pin for connecting to the connector port of the electronic device;

at least one magnetic member disposed on a coupling face of the connector to face the connector port and providing coupling strength caused by an attractive force with respect to at least one metal member disposed on the connector port; and a detection member disposed in the vicinity of the at least one connector pin of the connector and configured to facilitate an electrical connection with the electronic device only when the connector is coupled to the connector port, wherein when the detection member protrudes from the connector, power supplied from the external device, to the connector, is disconnected; and wherein when the detection member is depressed into the connector, power is supplied from the external device to the connector.

17. The connector device of claim 16, wherein the detection member is a detection pin that detects placement of the connector by being moved in a direction away from a surface of the connector port, when the connector is coupled to the connector port.

18. The connector device of claim 17, wherein the at least one connector pin is installed to be moveable in the direction away from the surface of the connector port when pressed, and the detection pin is disposed between a plurality of connector pins and is installed so as to be moveable together with the plurality of connector pins when pressed.

19. An electronic device comprising:

a connector port including at least one terminal and at least one magnetic member disposed in the vicinity of the at least one terminal; and a detection member for detecting a coupling of a connector connected to the connector port, wherein an electrical connection with the connector is completed when the coupling is detected by the detection member, and wherein when the detection member protrudes from the connector port, power supplied from an external device, to the connector port, is disconnected; and wherein the detection member is depressed into the connector port, power is supplied from the external device to the connector port.

20. The electronic device of claim 19, wherein the connector includes at least one metal member, and the coupling with the connector port is induced by magnetism by the magnetic member of the connector port.

* * * * *